US009844248B1

(12) United States Patent
Choi

(10) Patent No.: US 9,844,248 B1
(45) Date of Patent: Dec. 19, 2017

(54) BODY PIERCING DEVICE AND SYSTEM

(71) Applicant: Yong Kyu Choi, Los Angeles, CA (US)

(72) Inventor: Yong Kyu Choi, Los Angeles, CA (US)

( * ) Notice: Subject to any disclaimer, the term of this patent is extended or adjusted under 35 U.S.C. 154(b) by 0 days.

(21) Appl. No.: 15/275,137

(22) Filed: Sep. 23, 2016

(51) Int. Cl.
*A44C 15/00* (2006.01)
*A61J 11/00* (2006.01)

(52) U.S. Cl.
CPC ..... *A44C 15/0095* (2013.01); *A44C 15/0045* (2013.01); *A61J 11/00* (2013.01)

(58) Field of Classification Search
CPC . A44C 15/00; A44C 15/0045; A44C 15/0095; A44C 25/00; A44C 7/00; A44C 7/001; A44C 7/002; A44C 7/003; A61J 13/00; A61J 11/00
See application file for complete search history.

(56) References Cited

U.S. PATENT DOCUMENTS 5,239,841 A * 8/1993 Zwart ..... A44C 15/0095 63/12
5,732,714 A * 3/1998 Morrissey ..... A61F 13/141 128/846
7,662,018 B1 * 2/2010 Thompson ..... A61J 13/00 215/306
9,060,917 B1 * 6/2015 Tronson ..... A61J 9/00
2003/0073930 A1 * 4/2003 Morrissey ..... A61J 13/00 600/573
2006/0178601 A1 * 8/2006 Wang ..... A61H 9/005 601/14
2009/0308405 A1 * 12/2009 Yamashita ..... A61J 13/00 128/890
2012/0101575 A1 * 4/2012 Horne ..... A61F 2/12 623/8
2014/0316464 A1 * 10/2014 Morgetano ..... A61J 13/00 606/236
2016/0220451 A1 * 8/2016 Blank ..... A61J 13/00

* cited by examiner

*Primary Examiner* — Emily M Morgan
(74) *Attorney, Agent, or Firm* — Hankin Patent Law, APC; Kevin Schraven; Lindsey Auerbach

(57) ABSTRACT

A piercing accessory system, comprising: a platform; and a cover. The platform may comprise a cover coupling portion that may comprise a piercing receiving portion. The cover may comprise a platform coupling portion. The piercing receiving portion is preferably configured to connect to one or more piercing rods, such that the platform is attachable to a user that has one or more piercings; wherein the cover coupling portion and the platform coupling portion removeably couple together, such that the cover adorns the user.

3 Claims, 17 Drawing Sheets

BODY PIERCING DEVICE AND SYSTEM

FIELD OF USE

The present disclosure relates generally to piercing accessories and systems, and more particularly, to a piercing accessory and accessory system, which allows the addition of larger decorative pieces while utilizing a standard piercing.

BACKGROUND

Body art takes various forms and allows individuals to express themselves in different ways. One common segment of body art is body piercings. Although piercings are most commonly worn on the face, it has become increasingly common for piercings to be applied wherever on the body an individual desires to house a piercing.

There is an array of piercing device types, including studs, bars, plugs, hoops, naval, spiral, helix, septum, and other specialized types of piercings. Many of these piercings are designed stand alone and are limited to being what they are and looking like they do. Additionally, these piercings generally require that a user be able to have access to the locking mechanism for application and removal of the piercing.

Sometimes, changeable, larger, and/or more ornate decorative items may be desired to be worn as piercings but they are impractical to attach to a user's body directly. Additionally, a standard piercing is relatively simple, comprising one or more small holes in a user's skin. This limits the type of jewelry or accessory that may be worn and may also cause stability issues for larger pieces of jewelry. One possible option of using more than two holes to provide additional stability is also not practicable because of the logistics in manufacturing and wearing the piercings.

Additionally, where significant customization is desired, there are practical obstacles to allowing a user to deviate from regularly worn jewelry. Specifically, there are only so many holes a person can place on their body before that additional customization is simply not feasible. This scenario is especially noticeable in specific regions of a body, such as the nipples.

Therefore, there is a need for a new and improved piercing accessory that allows for user's to adorn themselves with larger or specialized pieces of jewelry.

SUMMARY OF EMBODIMENTS

To minimize the limitations in the prior art, and to minimize other limitations that will become apparent upon reading and understanding the present disclosure, the present specification discloses a new and improved piercing accessory and accessory system.

One embodiment of the piercing accessory may comprise a platform; and a cover; wherein the platform may comprise a cover coupling portion; wherein the cover coupling portion may comprise a piercing receiving portion; wherein the cover may comprise a platform coupling portion; wherein the piercing receiving portion may be configured to connect to one or more piercing rods, such that the platform may be attachable to a user that has one or more piercings; and wherein the cover coupling portion and the platform coupling portion may removeably couple together, such that the cover may be configured to adorn the user. The piercing accessory system may comprise a base. The base may be rounded and substantially circular. The piercing receiving portion may comprise two or more holes configured to receive the one or more piercing rods, such that the one or more piercing rods are configured to pass through a first of the two or more holes, then pass through the one or more piercings of the user, and then pass through a second of the two or more holes. The two or more holes may be four holes. The cover coupling portion may comprise a first magnet; and the platform coupling portion may comprise a second magnet. The first magnet may be housed at a distal end of the cover coupling portion; and the second magnet may be housed at a distal end of the platform coupling portion. The cover coupling portion may comprise a first connector; wherein the platform coupling portion may comprise a second connector; wherein the first connector and the second connector are configured to releaseably couple together. The first connector may be at a distal end of the cover coupling portion; and the second connector may be at a distal end of the platform coupling portion. The first and second connectors may be a lock-bar and slot; and the lock-bar may be configured to be inserted into the slot, such that the lock-bar and slot are able to be rotated in opposite directions from each other in order to releaseably couple the platform and the cover. The first connector may be a lock-bar and the second connector may be a slot. The first connector may be a slot and the second connector may be a lock-bar.

Another embodiment of the piercing accessory may comprise a platform; and a cover; wherein the platform may comprise a cover coupling portion and a base; wherein the cover coupling portion may comprise a piercing receiving portion; wherein the cover may comprise a platform coupling portion; wherein the piercing receiving portion may be configured to connect to one or more piercing rods, such that the platform may be attachable to a user that has one or more piercings; wherein the cover coupling portion and the platform coupling portion may removeably couple together, such that the cover may be configured to adorn the user; wherein the piercing receiving portion may comprise two or more holes configured to receive the one or more piercing rods, such that the one or more piercing rods are configured to pass through a first of the two or more holes, then pass through the one or more piercings of the user, and then pass through a second of the two or more holes; wherein the cover coupling portion further may comprise a first magnet; wherein the platform coupling portion may comprise a second magnet; wherein the first magnet may be housed at a distal end of the cover coupling portion; and wherein the second magnet may be housed at a distal end of the platform coupling portion. The base may be rounded and substantially circular. The two or more holes may be four holes.

Another embodiment of the piercing accessory may comprise a platform; and a cover; wherein the platform may comprise a cover coupling portion and a base; wherein the cover coupling portion may comprise a piercing receiving portion; wherein the cover may comprise a platform coupling portion; wherein the piercing receiving portion may be configured to connect to one or more piercing rods, such that the platform may be attachable to a user that has one or more piercings; wherein the cover coupling portion and the platform coupling portion removeably couple together, such that the cover may be configured to adorn the user; wherein the piercing receiving portion may comprise two or more holes configured to receive the one or more piercing rods, such that the one or more piercing rods are configured to pass through a first of the two or more holes, then pass through the one or more piercings of the user, and then pass through a second of the two or more holes; wherein the cover coupling portion may comprise a first connector; wherein the platform coupling portion may comprise a second connector; wherein the first connector and the second connector are configured to releaseably couple together; wherein the first connector may be at a distal end of the cover coupling portion; wherein the second connector may be at a distal end of the platform coupling portion. wherein the first and second connectors are a lock-bar and slot; and wherein the lock-bar may be configured to be inserted into the slot, such that the lock-bar and slot are able to be rotated in opposite directions from each other in order to releaseably couple the platform and the cover. The first connector may be a lock-bar and the second connector may be a slot. Alternatively, the first connector may be a slot and the second connector may be a lock-bar. The two or more holes may be four holes. The base may be rounded and substantially circular.

It is an object to provide a piercing accessory and accessory system that is adapted to allow for additions to existing piercings which would not be wearable otherwise.

It is an object to provide a piercing accessory and accessory system that has multiple functions.

It is an object to overcome the deficiencies of the prior art.

These, as well as other components, steps, features, objects, benefits, and advantages, will now become clear from a review of the following detailed description of illustrative embodiments, of the accompanying drawings, and of the claims.

BRIEF DESCRIPTION OF THE ILLUSTRATIVE EMBODIMENTS

The drawings show illustrative embodiments, but do not depict all embodiments. Other embodiments may be used in addition to or instead of the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

Figure 4A:
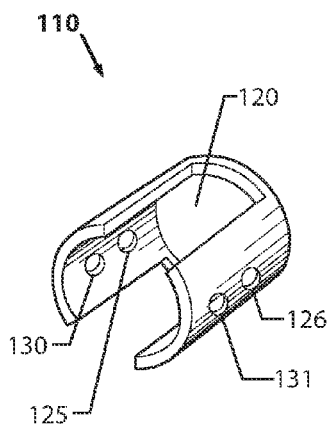
Figure 4B:
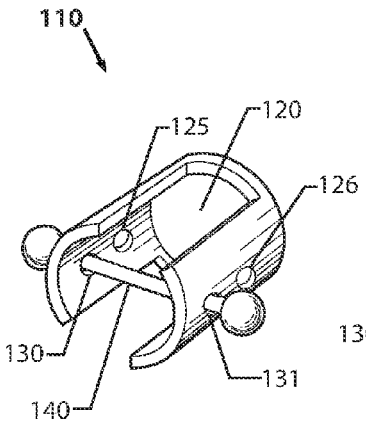
Figure 4C:
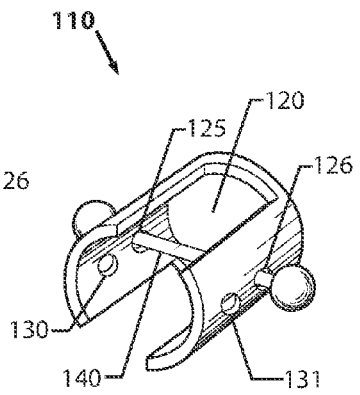

FIGS. 4*a*, 4*b*, and 4*c* are illustrations of perspective views of one embodiment of a coupling portion of the platform of the piercing accessory system.

Figure 5:
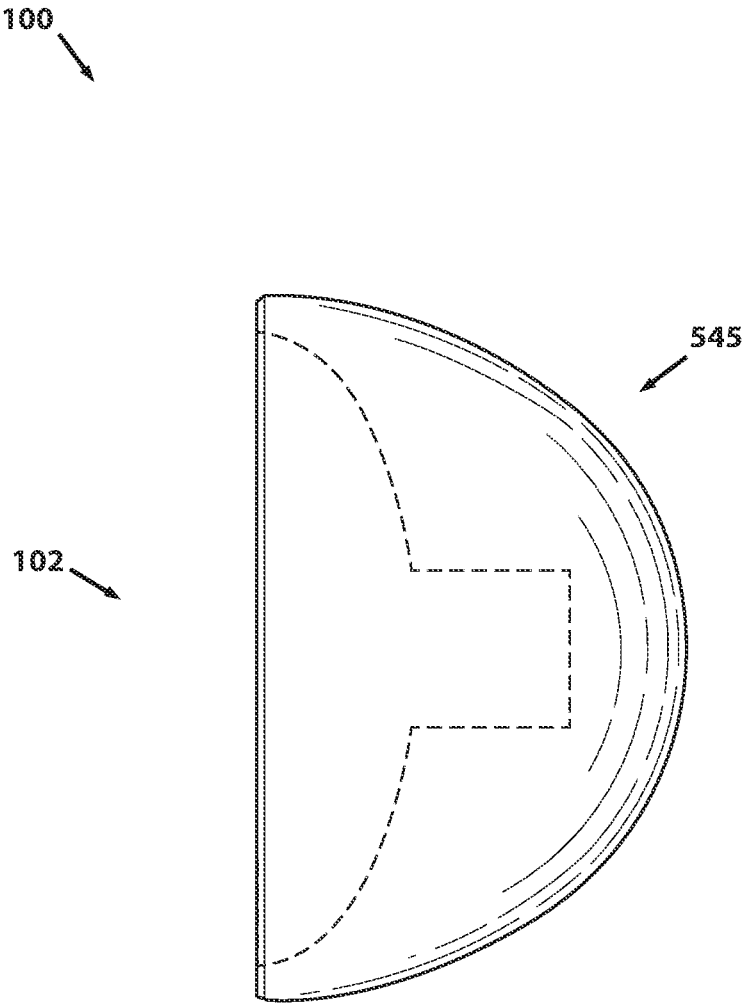

FIG. 5 is an illustration of a side view one embodiment of the platform overlaid with a cover.

Figure 6:
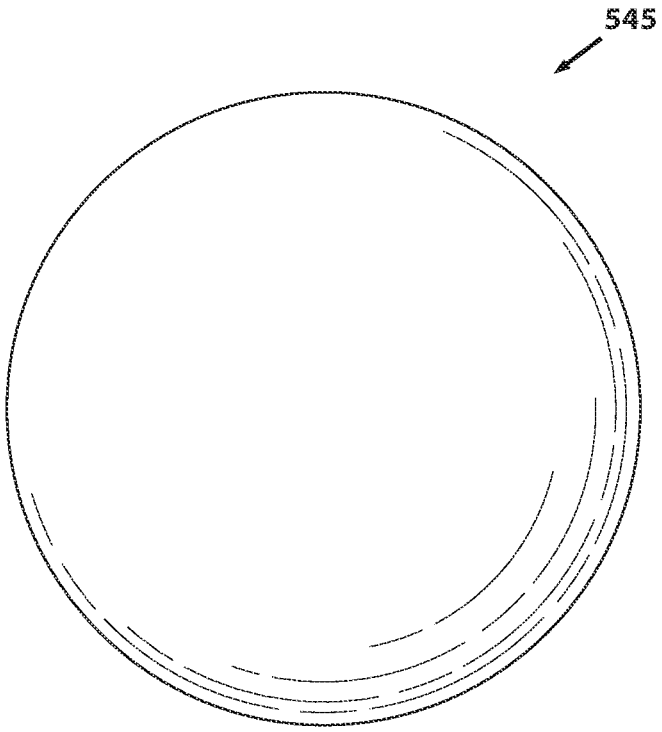

FIG. 6 is an illustration of a front view of one embodiment of the cover.

Figure 7:
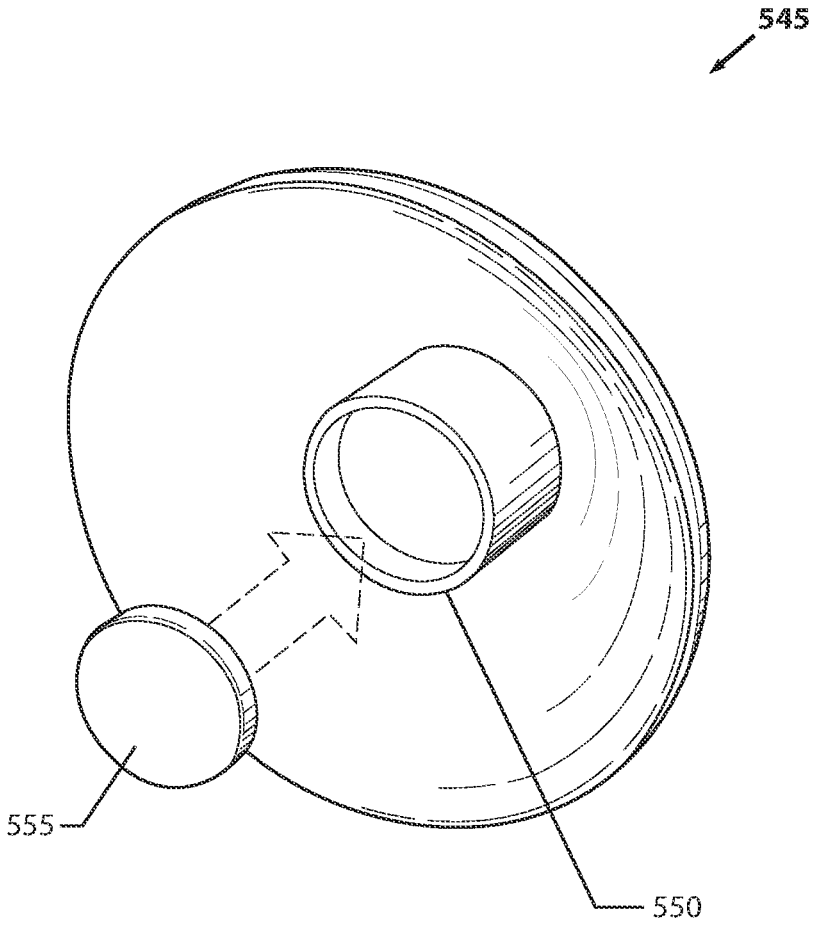

FIG. 7 is an illustration of a perspective view of an interior of one embodiment of a cover showing the coupling portion of the cover.

Figure 8:
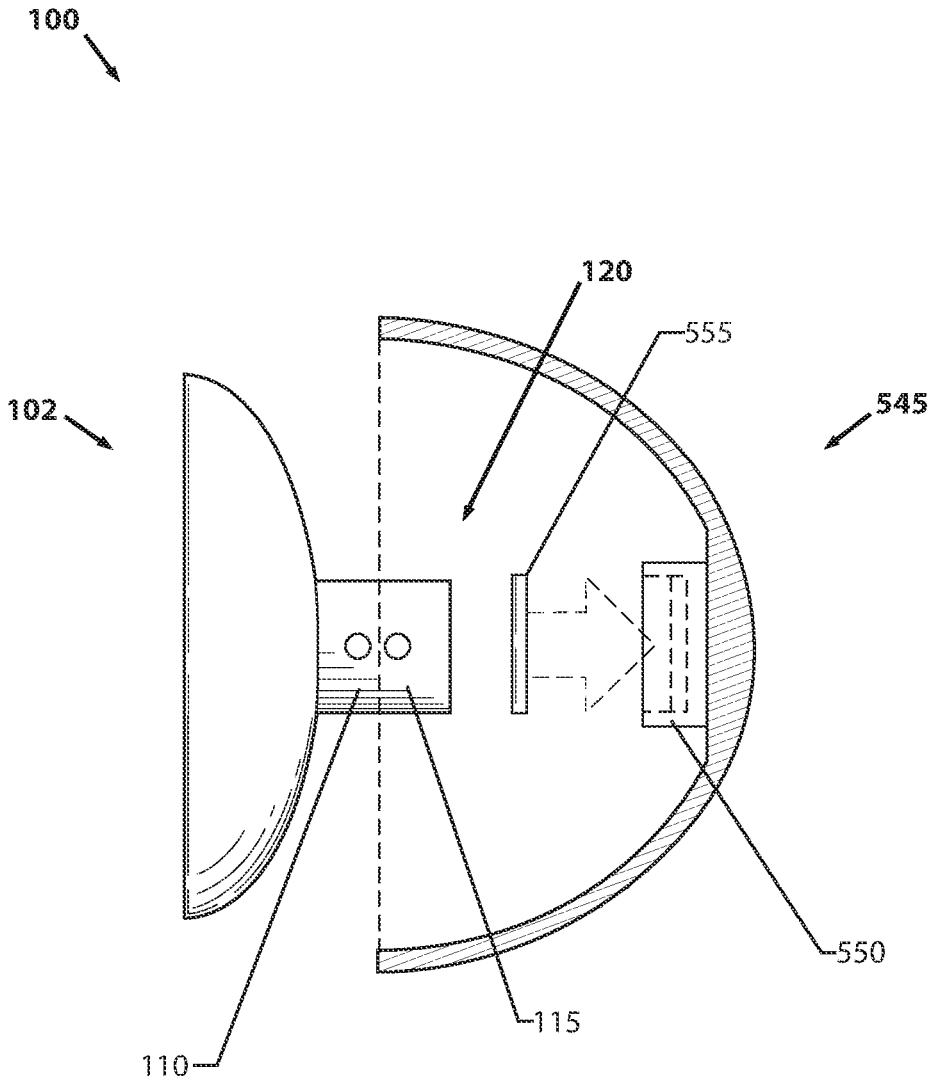

FIG. 8 is an illustration of an exploded and cross-section view of one embodiment of the piercing accessory system.

Figure 9:
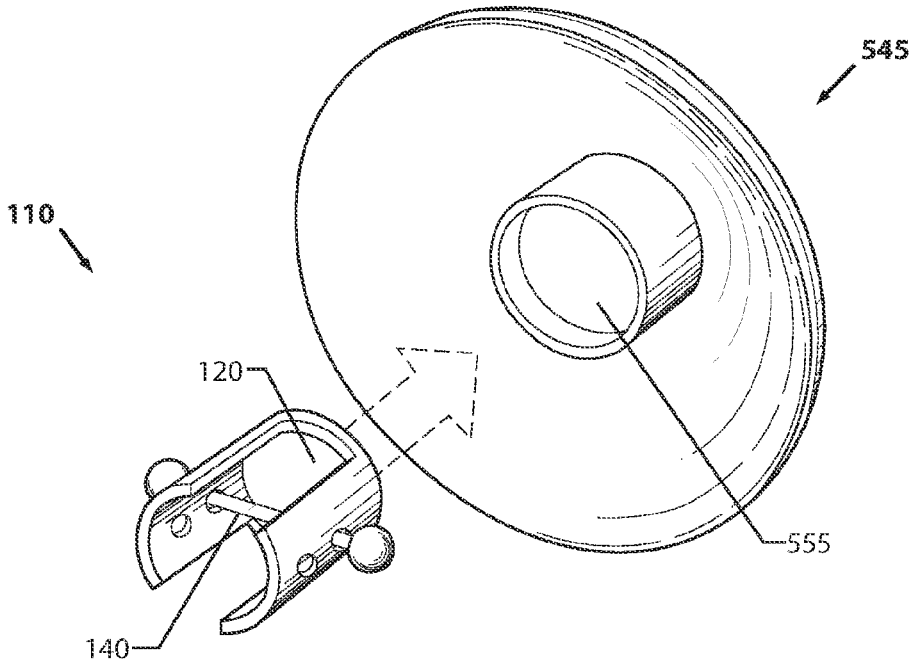

FIG. 9 is an illustration of a perspective view of the interior of one embodiment of the piercing accessory system showing the cover and coupling portion of the platform.

Figure 10:
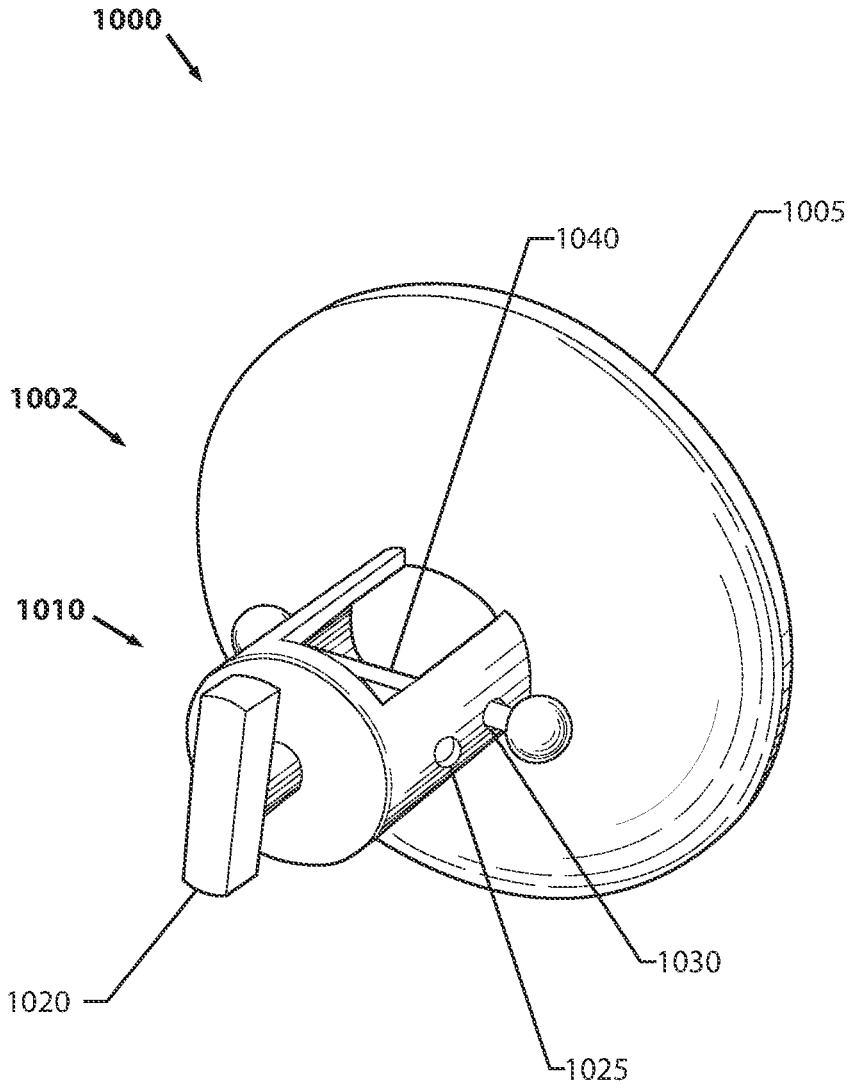

FIG. 10 is an illustration of a perspective view of another embodiment of a platform of the piercing accessory system.

Figure 11:
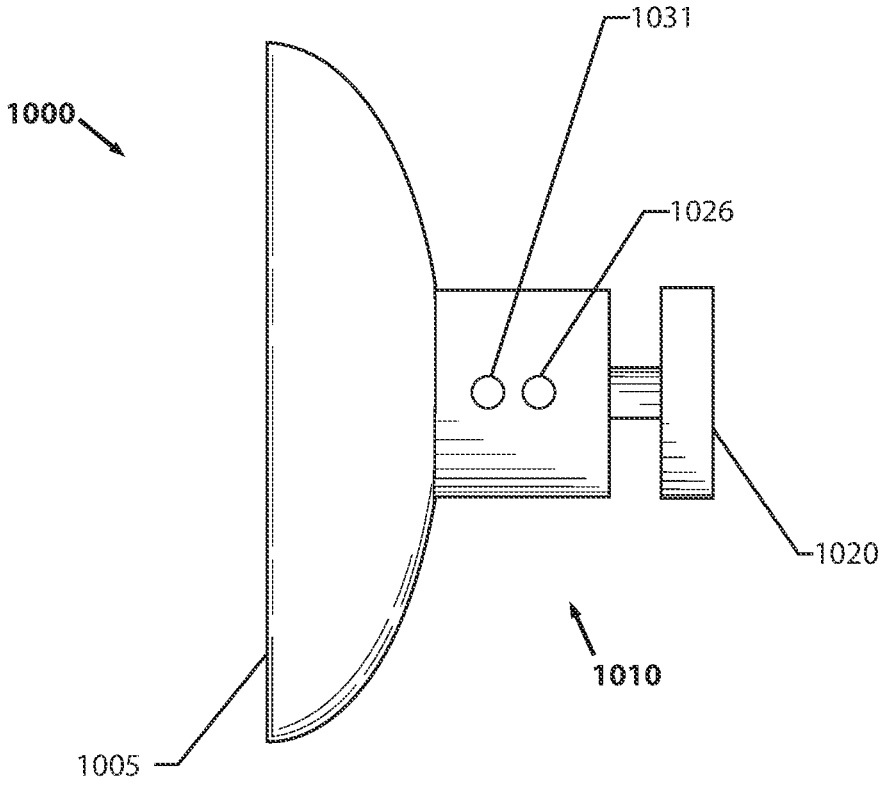

FIG. 11 is an illustration of a side view of another embodiment of platform of the piercing accessory system.

Figure 12:
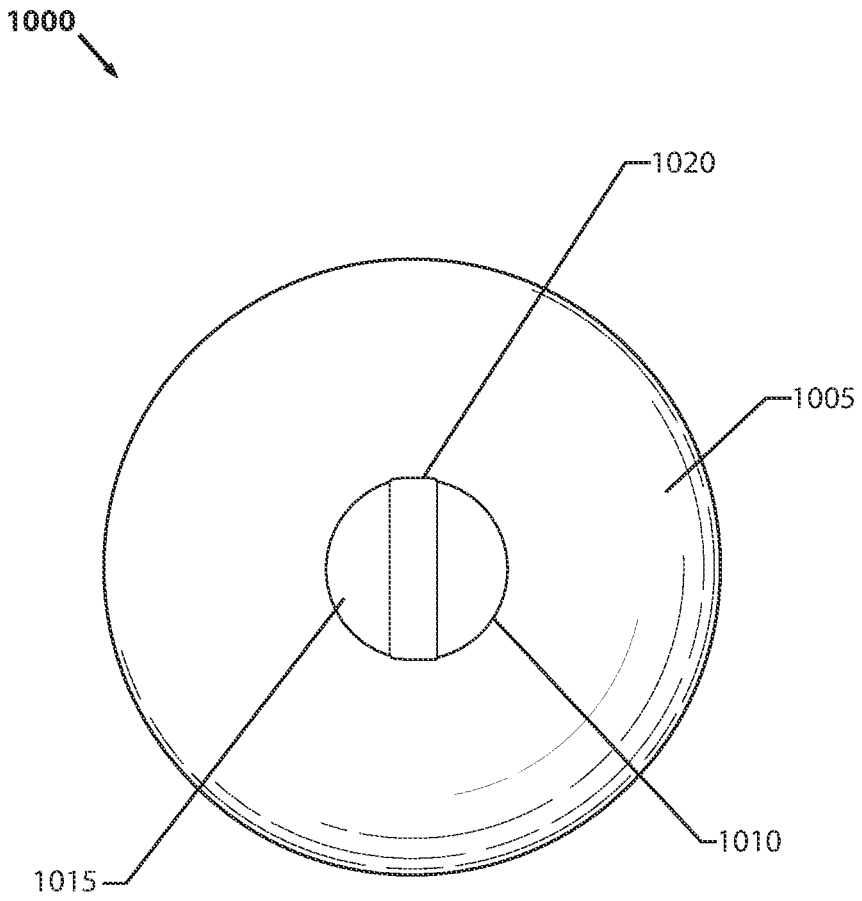

FIG. 12 is an illustration of a front view of another embodiment of the platform of the piercing accessory system.

Figure 13A:
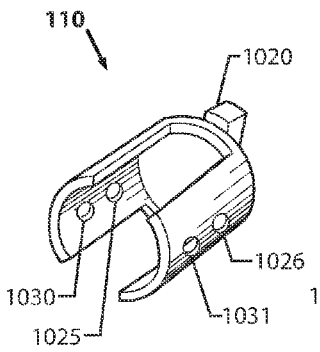
Figure 13B:
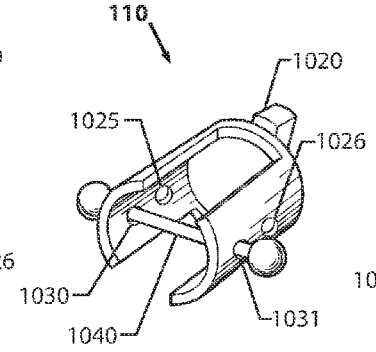
Figure 13C:
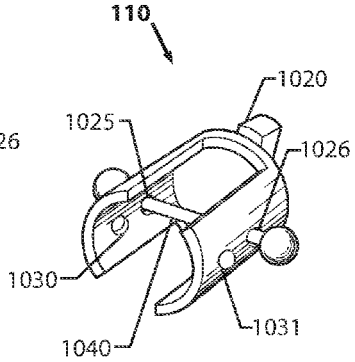

FIGS. 13*a*, 13*b*, and 13*c* are illustrations of perspective views of another embodiment of a coupling portion of the platform of the piercing accessory system.

Figure 14:
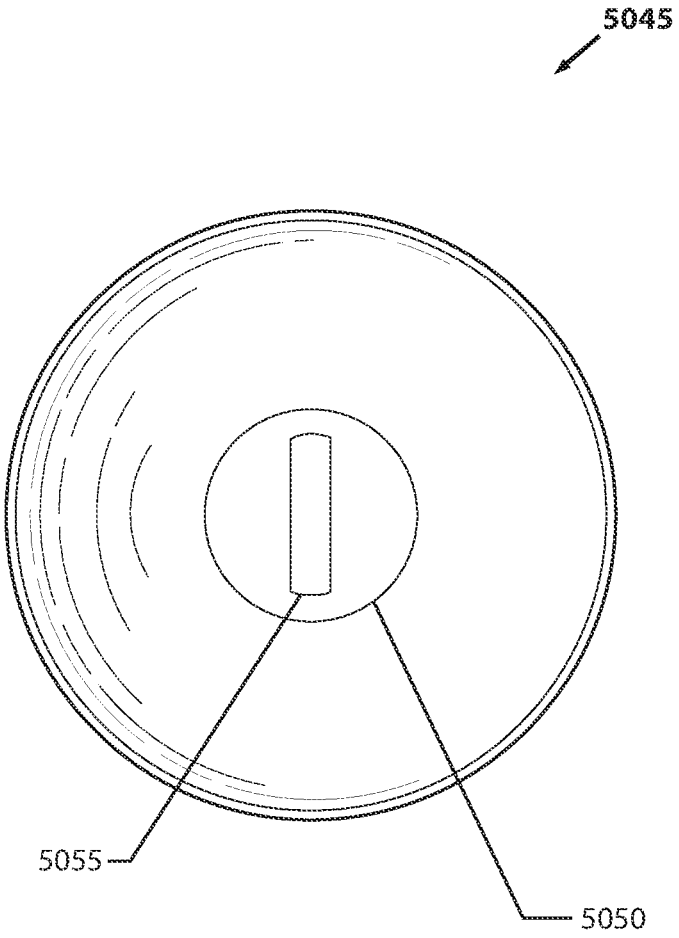

FIG. 14 is an illustration of a rear view of another embodiment of the cover portion shown the coupling portion.

Figure 15A:
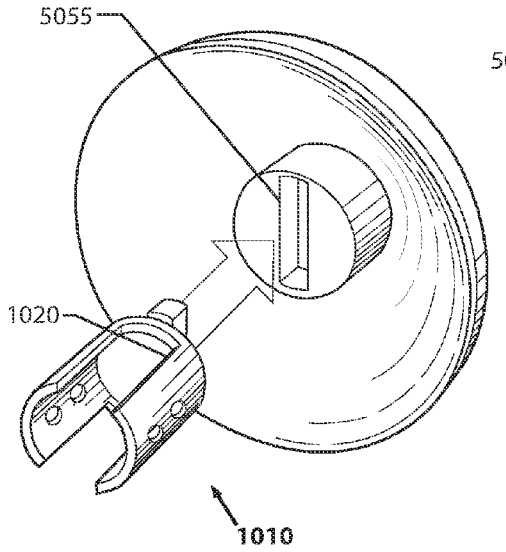
Figure 15B:
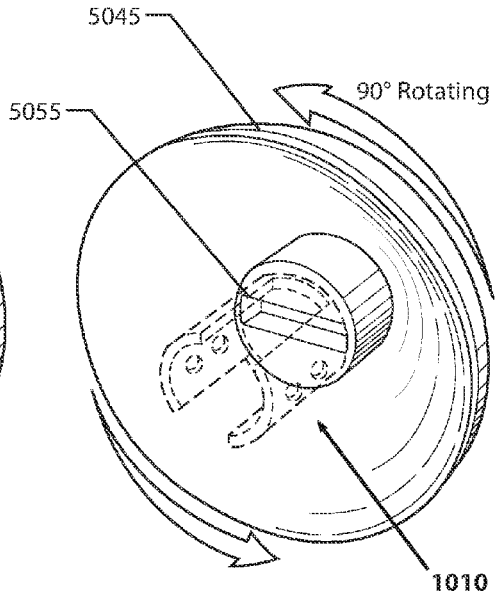

FIGS. 15*a* and 15*b* are illustrations of rear perspective views of another embodiment of the piercing accessory system showing how the cover and coupling portion of the platform join.

Figures 16A, 16B:
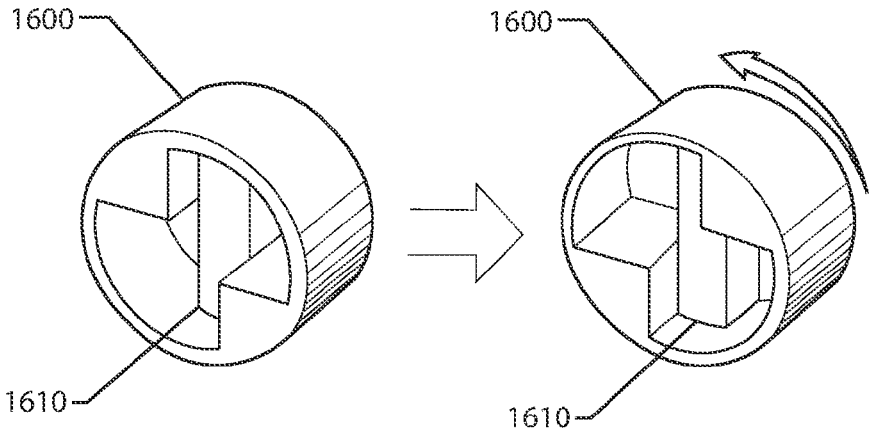

FIGS. 16*a* and 16*b* are illustrations of perspective views of an interior of the coupling portion of another embodiment of the cover.

Figures 17A, 17B:
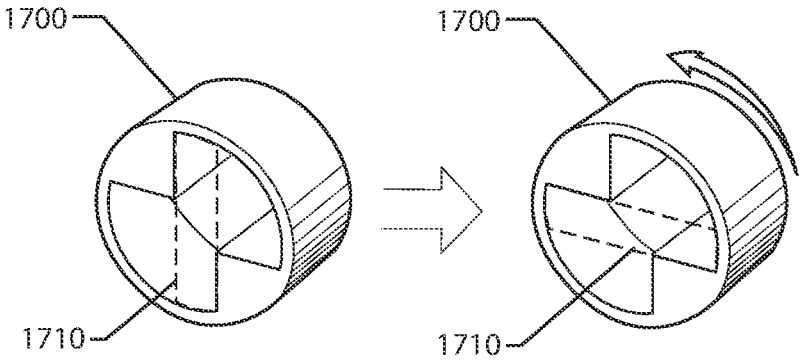

FIGS. 17*a* and 17*b* are illustrations of perspective views of an interior of the coupling portion of another embodiment of the cover.

DETAILED DESCRIPTION OF THE ILLUSTRATIVE EMBODIMENTS

In the following detailed description of various embodiments, numerous specific details are set forth in order to provide a thorough understanding of various aspects of the embodiments. However, the embodiments may be practiced without some or all of these specific details. In other instances, well-known procedures and/or components have not been described in detail so as not to unnecessarily obscure aspects of the embodiments.

While some embodiments are disclosed here, other embodiments will become obvious to those skilled in the art as a result of the following detailed description. These embodiments are capable of modifications of various obvious aspects, all without departing from the spirit and scope of protection. The figures, and their detailed descriptions, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

Figure 1:
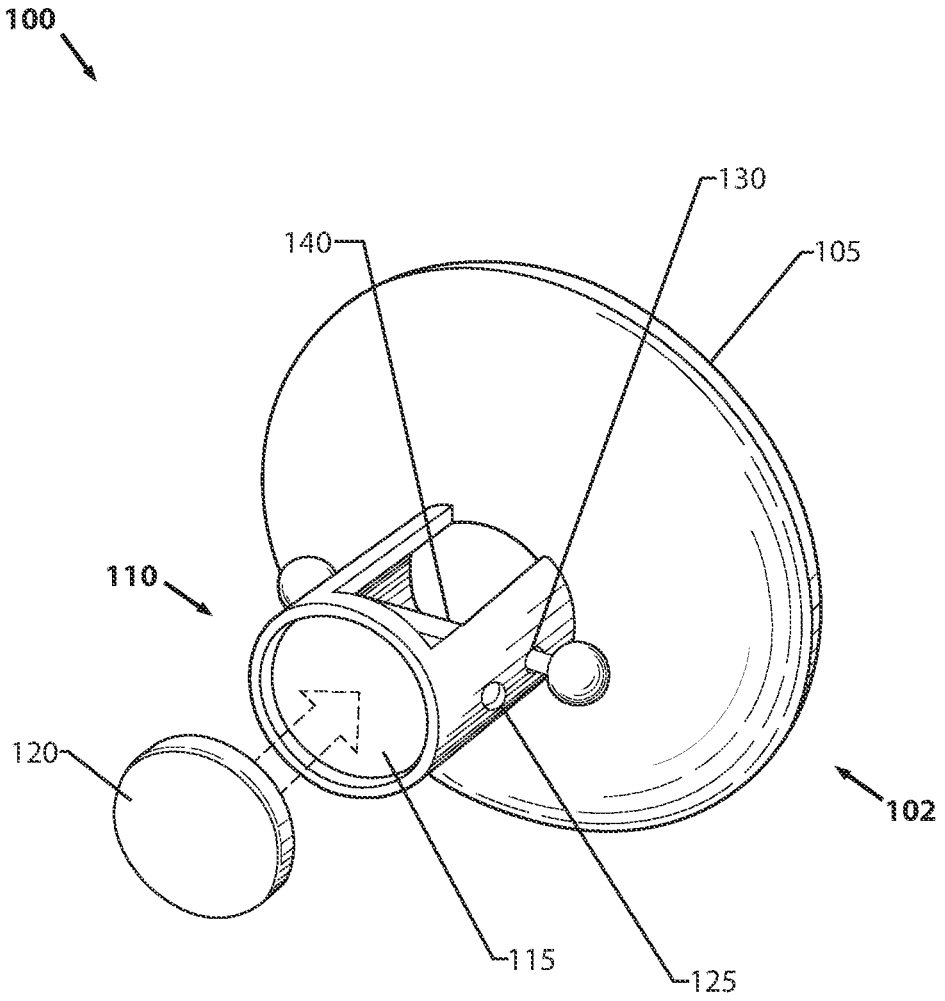
FIG. 1 is an illustration of a perspective view of one embodiment of the piercing accessory system.

FIG. 1 is an illustration of a perspective view of one embodiment of the piercing accessory system. As shown in FIG. 1, the platform 102 of the piercing accessory system 100 may comprise a base portion 105, and a cover coupling portion 110. The base portion 105 and cover coupling portion 110 are preferably a single unit, but they may be two or more portions connected together. FIG. 1 shows that the cover coupling portion 110 may comprise a distal end 115 and holes 125, 126, 130, 131 (holes 126 and 131 are shown in later FIGS. 2 and 4). The distal end 115 may be an indentation configured to receive a first magnet 120. The indentation may be a recessed cavity substantially formed in the shape of the first magnet 120, such that the first magnet may fit snuggly within the indentation such that all sides but one sides of the first magnet 120 are covered by the distal end 115. The magnet 120 may be secured within the distal end 115 with an adhesive, friction, ultrasonic welding, welding, soldering, clamp, threads, screw, bolt, or other connectors of the like. Together, the distal end 115 and first magnet 120 may be one embodiment of a cover coupling portion or system. The distal end 115 may also comprise a lip or other means for securing the first magnet 120.

The holes 125, 126, 130, 131 may be configured to receive one or more piercing studs or rods 140, which may pass through or pierce a piercing on a user's body. The piercing rod 140 may be a rod, stud, or bar type piercing, or any type of piercing which may engage the user and any number of the holes 125, 126, 130, 131. In one embodiment, the holes 125, 126, 130, 131 may comprise two sets of holes, a first set of holes 125, 126 and a second set of holes 130, 131, wherein each set of holes may be capable of receiving a piercing rod, wherein a are configured to receive a rod-type piercing, and are configured to receive a rod-type piercing. The holes 125, 126, 130, 131 may have alternate arrangements for receiving various types of piercings. FIG. 1 shows how the piercing rod 140 may have end caps that are removeably connectable to the piercing rod 140, such that the piercing rod passes through the first hole of one of the sets of holes, the skin or soft tissue of the user, preferably a nipple, and then passes through the second hole of the set of holes. The stud cap or end cap is then connected, preferably screwed, to the end of the piercing rod 140, such that the platform is now removeably connected to the user.

In one embodiment, the platform may be removeably secured to a user's body. Specifically, where the user has a rod-type piercing, the user may place the platform 102 over the area where the rod-type piercing may be affixed, and put on the rod-type piercing as normal, but with the rod-type piercing going through two or more of the holes 125, 126, 130, 131. In one embodiment, the rod-type piercing may be applied to a nipple, such that the platform 102 substantially covers part or all of the user's nipple. Once applied to the user's body, the platform may be used to add additional accessories by way of the cover coupling portion. As shown in FIG. 1, the base 105 is preferably a concave disc shape that may conform to the nipple and or breast of a wearer.

Figure 2:
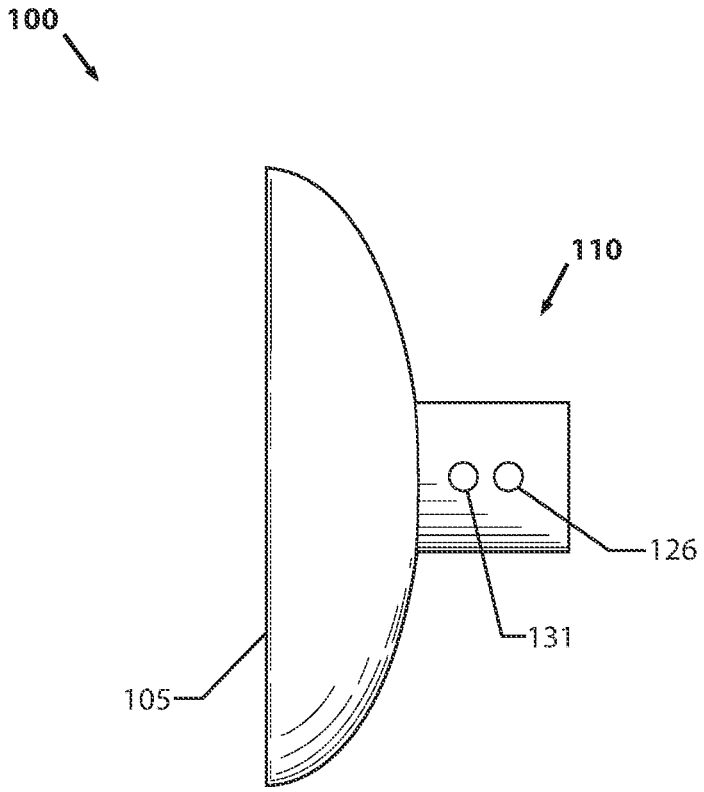
FIG. 2 is an illustration of a side view of one embodiment of platform of the piercing accessory system.

FIG. 2 is an illustration of a side view of one embodiment of platform of the piercing accessory system. As shown in FIG. 2, the piercing accessory system 100 may comprise a base portion 105, and a cover coupling portion 110. The cover coupling portion 110 may have holes 126, 131. As shown in FIG. 2, the base portion 105 may be rounded or curved to conform to the body of the user. FIG. 2*b* shows the rod 140 engaged with holes 130 and 131. FIG. 2*c* shows the rod engaged with holes 125 and 126. Alternatively two rods may be used. In some embodiments there may be additional holes or the rods may be connected or part of the platform 102.

Figure 3:
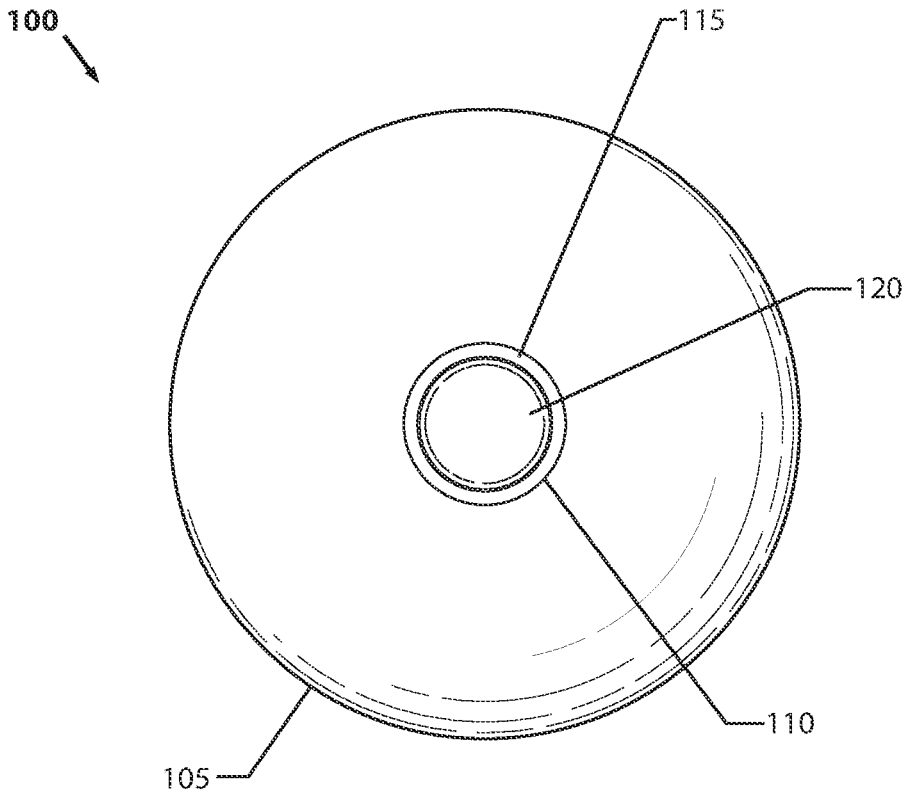
FIG. 3 is an illustration of a front view of one embodiment of the platform of the piercing accessory system.

FIG. 3 is an illustration of a front view of one embodiment of the platform of the piercing accessory system. As shown in FIG. 2, the piercing accessory system 100 may comprise a base portion 105, a cover coupling portion 110, and a magnet 120. FIG. 3 shows that the magnet 120 is contained within distal end 115.

FIGS. 4*a*, 4*b*, and 4*c* are illustrations of perspective views of one embodiment of a coupling portion of the platform of the piercing accessory system. As shown in FIGS. 4*a*, 4*b*, and 4*c*, a cover coupling portion 110 may allow for one or more different configurations of a piercing rod 140 to pass through the holes 125, 126, 130, 131. This may allow for a user to adjust how snugly the platform 102 engaged the user's skin, to help reduce the amount of tension on the user's skin or adjust how much bouncing or shifting the platform 102 does with respect to the user's nipple.

FIG. 5 is an illustration of a side view one embodiment of the platform overlaid with a cover. As shown in FIG. 5, a cover 545 may substantially encapsulate the platform 102 so as to allow a different aesthetic, which may be free of indications of piercings. The cover 545 may take substantially any shape or appearance, provided that some portion of the cover 545 is able to engage the platform 102 and be held substantially in place. FIG. 5 shows that the cover may be a rounded cup that forms around the platform 102, and thus around the user's nipple or breast. FIG. 5 shows one embodiment of the entire piercing accessory system.

FIG. 6 is an illustration of a front view of one embodiment of the cover 545.

FIG. 7 is an illustration of a perspective view of an interior of one embodiment of a cover showing the coupling portion of the cover. As shown in FIG. 7, the cover 545 may comprise a platform coupling portion 550. The platform coupling portion 550 may be configured to receive a second magnet 555, such that the second magnet 555 may be permanently attached or removeable from platform coupling portion 550. Together, the platform coupling portion 550 and second magnet 555 may be one embodiment of a platform coupling device. As shown in FIG. 7, the platform coupling portion 550 may also comprise a lip or other means for securing the second magnet 555.

FIG. 8 is an illustration of an exploded and cross-section view of one embodiment of the piercing accessory system 100. As shown in FIG. 8, the platform 102 and cover 545 may be configured to releaseably engage one another. Specifically, the distal end 115 of coupling portion 110, which contains first magnet 120, may releaseably engage the platform coupling portion 550, which contain second magnet 555. The cover coupling portion 110 may have substantially the same diameter as the platform coupling portion 550. Alternatively, the cover coupling portion 110 and coupling portion 550 may fit over or within one another to further hold the two releaseably together.

FIG. 9 is an illustration of a perspective view of the interior of one embodiment of the piercing accessory system showing the cover and coupling portion of the platform. As shown in FIG. 9, the cover coupling portion 110 and cover 545 may be configured to releaseably engage one another after the coupling portion is attached to a wearer via piercing rod 140. Once the cover coupling portion 110 is attached to the wearer, the user may removeably connect a cover 545 or one of many different types of covers to and from the cover coupling portion 110.

FIG. 10 is an illustration of a perspective view of another embodiment of a platform of the piercing accessory system. As shown in FIG. 10, one embodiment of the platform 1002 of the piercing accessory system 1000 may comprise a base portion 1005 and a coupling portion 1010. The base portion 1005 may be connected to the coupling portion 1010. The coupling portion 1010 may comprise a distal end 1015 and holes 1025, 1026, 1030, 1031 (holes 1026 and 1031 are shown in FIGS. 13*a*-*c*). The distal end 1015 may further comprise a lock-bar 1020, such that a leg of the lock-bar 1020 is substantially perpendicularly connected to a distal end 1015 and the arms of the lock-bar 1020 are perpendicularly connected to the leg of the lock bar. Together, the distal end 1015 and lock-bar 1020 may be one embodiment of a cover coupling device. The lock-bar 1020 may be a variety of structures and connectors that act to physically connect two parts of a device together.

The holes 1025, 1026, 1030, 1031 may be configured to receive a piercing rod 1040 worn on a user's body. The piercing rod 1040 may be a rod-type piercing, or any type of piercing device that may engage any number of the holes 1025, 1026, 1030, 1031. In one embodiment, the holes 1025, 1026, 1030, 1031 may comprise two sets of holes, each set of holes capable of receiving a piercing rod, wherein a first set of holes 1025, 1026 are configured to receive a rod-type piercing, and a second set of holes 1030, 1031 are configured to receive a rod-type piercing. The holes 1025, 1026, 1030, 1031 may have alternate arrangements for receiving various types of piercing devices. In one embodiment, the platform 1002 may be removeably secured to a user's body. Specifically, where the user has a rod-type piercing, the user may place the platform 1020 over the area where the rod-type piercing may be affixed, preferably a nipple, and put on the rod-type piercing as normal, but with the rod-type piercing going through two or more of the holes 1025, 1026, 1030, 1031. In one embodiment, the rod-type piercing may be applied to a nipple, such that the platform 1002 covers part or all of the user's nipple. Once applied to the user's body, the platform 1002 may be used to add additional accessories by way of the cover coupling portion 1010.

FIG. 11 is an illustration of a side view of another embodiment of platform of the piercing accessory system. As shown in FIG. 11, the piercing accessory system 1000 may comprise a base portion 1005 and a coupling portion 1010. The coupling portion 1010 may have holes 1026, 1031. As shown in FIG. 11, the base portion 1005 may be rounded or curved to conform to the body of the user. FIG. 11 shows that the piercing accessory system 1000 preferably has connector 1020, which as shown is a male lock bar that is half of a connection system.

FIG. 12 is an illustration of a front view of another embodiment of the platform of the piercing accessory system. As shown in FIG. 12, the piercing accessory system 1000 may comprise a base portion 1005, a coupling portion 1010, and a lock-bar connector 1020. FIG. 3 shows that the lock-bar connector 1020 is at the end of distal end 1015.

FIGS. 13*a*, 13*b*, and 13*c* are illustrations of perspective views of another embodiment of a coupling portion of the platform of the piercing accessory system. As shown in FIGS. 13*a*, 13*b*, and 13*c*, a coupling portion 1010 may allow for one or more different configurations of a piercing rod 1040 to pass through the holes 1025, 1026, 1030, 1031. This may allow for a user to adjust how snugly the platform 1002 engaged the user's skin, to help reduce the amount of tension on the user's skin or adjust how much bouncing or shifting the platform 1002 does with respect to the user's nipple. FIG. 13*b* shows the rod 1040 engaged with holes 1030 and 1031. FIG. 13*c* shows the rod engaged with holes 1025 and 1026. Alternatively two rods may be used. In some embodiments there may be additional holes or the rods may be connected or part of the platform 1002.

FIG. 14 is an illustration of a rear view of another embodiment of the cover portion shown the coupling portion. As shown in FIG. 14, a cover 5045 may comprise a platform coupling portion 5050. The platform coupling portion 5050 comprise slot 5055, which as shown may be a lock-bar engaging portion. The slot 5055 may be configured such that a lock-bar 1020 may releaseably engage the slot 5055 by inserting and twisting. In an alternate embodiment, the positions of a lock-bar and lock-bar engaging portion may have the female/male relationship reversed, as shown in FIGS. 17*a-b*, such that the lock-bar is attached to the cover, and the slot is attached to the platform.

FIGS. 15*a* and 15*b* are illustrations of rear perspective views of another embodiment of the piercing accessory system showing how the cover and coupling portion of the platform join. FIGS. 15*a* and 15*b* show that the cover 5045 and slot 5055 may be aligned with connector 1020, which is then inserted into slot 5055 and then cover 5045 is twisted to releaseably lock the two portions of the system together.

FIGS. 16*a* and 16*b* are illustrations of perspective views of an interior of the coupling portion of another embodiment of the cover. As shown in FIGS. 16*a* and 16*b*, in one embodiment of the piercing accessory system, the lock-bar engaging portion 1600 may rotate while the lock-bar 1610 remains substantially stationary. The lock-bar engaging portion 1600 and lock-bar 1610 may be on either the platform or the cover.

FIGS. 17*a* and 17*b* are illustrations of perspective views of an interior of the coupling portion of another embodiment of the cover. As shown in FIGS. 17*a* and 17*b*, in one embodiment of the piercing accessory system, the lock-bar engaging portion 1700 may remain substantially stationary while the lock-bar 1710 rotates. The lock-bar engaging portion 1700 and lock-bar 1710 may be on either the platform or the cover.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description. These embodiments are capable of modifications in various obvious aspects, all without departing from the spirit and scope of protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

What is claimed is:

1. A piercing accessory system, comprising:

a platform; and a cover;

wherein said platform comprises a cover coupling portion;

wherein said cover coupling portion comprises one or more holes;

wherein said cover comprises a platform coupling portion;

wherein said one or more holes are configured to connect to one or more piercing rods, such that said platform is attachable to a user that has one or more piercings;

wherein said cover coupling portion and said platform coupling portion removeably couple together, such that said cover is configured to adorn said user;

wherein said cover coupling portion comprises a first connector;

wherein said platform coupling portion comprises a second connector;

wherein said first connector and said second connector are configured to releaseably couple together;

wherein said first and second connectors are a lock-bar and slot; and wherein said lock-bar is configured to be inserted into said slot, such that said lock-bar and slot are able to be rotated in opposite directions from each other in order to releaseably couple said platform and said cover.

2. The piercing accessory system of claim 1, wherein said first connector is a lock-bar and said second connector is a slot.

3. The piercing accessory system of claim 1, wherein said first connector is a slot and said second connector is a lock-bar.

* * * * *